US006794975B2

(12) United States Patent
Iwao et al.

(10) Patent No.: US 6,794,975 B2
(45) Date of Patent: Sep. 21, 2004

(54) NON-CONTACT TRANSFORMER

(75) Inventors: Seiichi Iwao, Hikone (JP); Yoshinori Katsura, Hikone (JP); Mikihiro Yamashita, Echi-gun (JP)

(73) Assignee: Matsushita Electric Works, Ltd., Osaka (JP)

( * ) Notice: Subject to any disclaimer, the term of this patent is extended or adjusted under 35 U.S.C. 154(b) by 43 days.

(21) Appl. No.: 10/253,699

(22) Filed: Sep. 25, 2002

(65) Prior Publication Data

US 2003/0058075 A1 Mar. 27, 2003

(30) Foreign Application Priority Data

Sep. 26, 2001 (JP) ..... 2001-293596

(51) Int. Cl.[7] ..... H01F 27/02
(52) U.S. Cl. ..... 336/96; 336/90
(58) Field of Search ..... 336/83, 90, 94, 336/96, 115–128, 130–135, 165, 178

(56) References Cited

U.S. PATENT DOCUMENTS 3,418,552 A 12/1968 Holmes
4,112,481 A 9/1978 Roge et al.
4,749,993 A 6/1988 Szabo et al.
5,855,261 A * 1/1999 Odachi et al. ..... 191/10
6,388,548 B1 * 5/2002 Saito et al. ..... 336/90
6,489,874 B2 * 12/2002 Katsura et al. ..... 336/130

FOREIGN PATENT DOCUMENTS

DE 1076817 3/1960
JP 2003-86440 * 3/2003

* cited by examiner

*Primary Examiner*—Tuyen T. Nguyen
(74) *Attorney, Agent, or Firm*—Greenblum & Bernstein, P.L.C.

(57) ABSTRACT

A non-contact transformer includes a transformer component provided on the floor of a housing, a printed circuit board on the transformer component, and an empty core space is formed within the transformer component wherein deformation of the housing is prevented through a construction that evacuates residual air from the core space when the core space is filled with resin even though both ends of the core space are covered by lid-like parts. A cylindrical end face at one extremity of the primary transformer component is positioned on the bottom plate of the primary housing opposed to the secondary housing, and the printed circuit board is provided on an opposite cylindrical end face which is at the other extremity of the primary transformer component. A passage is formed between the printed circuit board and the primary transformer component to provide a connecting orifice between a core space of primary transformer component and the space external to the primary transformer component.

19 Claims, 7 Drawing Sheets

NON-CONTACT TRANSFORMER

BACKGROUND OF THE INVENTION

1. Field of the Invention

The present invention relates to a non-contact transformer in which electrical current is transmitted between non-contacting first and second transformer components located in mutual opposition to each other.

2. Description of Background Information

Conventional transformer T, as shown in FIG. 6, includes a primary transformer component 3 installed within primary housing 2, and secondary transformer component 5 installed within secondary housing 4, the housings being oriented in mutual opposition to each other. Electromagnetic inductance, which occurs between primary coil 8 of primary transformer component 3 and secondary coil 9 of secondary transformer component 5, induces non-contact electrical current transmission between primary transformer component 3 and secondary transformer component 5. Due to its ability to provide non-contact electrical current transmission, non-contact transformer T can be provided for example, in an electrical appliance that is exposed to water such as an electric toothbrush or electric shaver shown as appliance X in FIG. 6, and into charging device Y which is used to electrically charge appliance X. The non-contact transformer allows charging device Y to safely supply electricity to the terminals on appliance X, even when appliance X is wet, without a physical connection being established between appliance X and charging device Y. With primary transformer component 3 installed within primary housing 2 to form charging unity Y, core space 1 is provided in secondary transformer component 5, instead of a solid ferrous core, in order to lower manufacturing costs, and the internal space of primary housing 2 is completely filled with resin 6 (FIG. 7) in order to improve heat dissipation and to waterproof the transformer. When resin 6 is poured into the internal space of primary housing 2, bottom plate 2*a* of primary housing 2 acts as the floor of the housing which is filled with resin 6. Because primary transformer component 3 is completely immersed within resin 6, core space 1 of primary transformer component 3 also becomes filled with resin 6.

It is desirable to bring primary transformer component 3 and secondary transformer component 5 into the closest mutual proximity to each other in order to obtain maximum electromagnetic inductance efficiency. To this end, the cylindrical end faces of primary housing 2 and secondary housing 4 (bottom plates 2*a* and 4*a* in this example) are brought into mutual contact. Terminals 12 are provided at the cylindrical end face of primary transformer component 3 opposite to bottom plate 2*a* of primary housing 2, and printed circuit board 7. As core space 1 is to be filled with resin 6, small gaps are provided between the respective cylindrical end faces of primary transformer component 3 where they meet bottom plate 2*a* of primary housing 2 and printed circuit board 7 in order to allow resin 6 to flow into core space 1. There is an inherent shortcoming, however, in that air core space 1 is a difficult space to fill with resin 6 because air present in core space 1 can become entrapped within resin 6 (residual air 15) with the inflow resin 6. The entrapment of residual air 15 within resin 6 can result in the distortion or breakage of primary housing 2 due to residual air 15 expanding from heat generated by the operation of primary transformer component 3.

SUMMARY OF THE INVENTION

Taking the above inherent problems into consideration, the present invention proposes a structure for non-contact transformer whereby the entrapment of residual air within the resin can be prevented and distortion and damage to the primary housing eliminated even though one side of the transformer core space is covered by the lower plate of the housing and the other side is covered by a printed circuit board.

The non-contact transformer of the present invention provides the following construction. A cylindrically shaped primary transformer component, which is installed within the primary housing, and cylindrically shaped secondary transformer component, which is installed with the secondary housing, are located in mutual opposition. An electromagnetic induction effect, occurring between the primary coil of the primary transformer component and the secondary coil of the secondary transformer component, induces non-contact electrical current transmission between the primary transformer component and the secondary transformer component. A cylindrical end face located on one side of the primary transformer component is attached to a bottom plate of primary housing which is located in opposition to the secondary housing. A printed circuit board, located on the other side of the primary transformer component, is provided on the cylindrical end face to which the terminals are attached. As the transformer component is enveloped within resin which fills the primary housing, a passage is provided between the printed circuit board and the primary transformer component. Even though bottom plate of the primary housing and the printed circuit board define a core space of the primary transformer component as a predominantly covered space, because the passage, which is located between the circuit board and the primary transformer component, provides a connecting space between the core space and the space external to the primary transformer component, the passage is able to guide the flow of resin into the core space while the air present in the core space exits to the space external to the core space at the time when the primary transformer becomes immersed within resin that fills primary housing. The result is that resin is able to flow into the core space of the primary transformer without entrapping residual air (FIG. 7).

The non-contact transformer of the present invention may include the provision of an external orifice which is located opposite to resin inflow point G within the primary housing and which opens to the space external to the primary transformer component at the end of the passage. As a result of this construction, resin will first flow around the external perimeter of the primary transformer component and then into the core space through the passage. That is, after first flowing into the space between the outer perimeter of the primary transformer component and the primary housing, a fairly steady volume of resin will flow smoothly through the passage to the core space. In other words, this structure is able to prevent the passage from becoming suddenly filled by a fast inflow of resin which would prevent air from escaping from the core space. A mechanism is thus formed which creates a more stable flow of resin into the core space to further reduce the chances of residual air from the core space becoming entrapped within resin.

The non-contact transformer of the present invention may include the provision of a resin passage, located between the bottom plate of the primary housing and the primary transformer component, that connects the core space of the primary transformer component to the space external to the primary transformer component. The resin passage is thus able to direct the flow of resin from within the primary housing into the core space to the external environment. The separate functions provided by the passages allow for the escape of air from the core space and for the smooth flow of resin into the core space and thus form a mechanism able to further reduce the possibility of trapping the air present in the core space as residual air within resin.

An aspect of the present invention provides a non-contact transformer including a primary cylindrical transformer component provided within a primary housing and a secondary cylindrical transformer component provided within a secondary housing located opposite the primary housing to induce non-contact electrical current transmission between the primary transformer component and the secondary transformer component through electromagnetic inductance occurring between a primary coil in the primary transformer component and a secondary coil in the secondary transformer component, the non-contact transformer including a cylindrical end face of the primary transformer component provided on a bottom plate of the primary housing located opposite the secondary housing; a printed circuit board with terminals attached thereto provided on another cylindrical end face of the primary transformer component; and a passage that receives resin as the primary transformer component is immersed in resin filling the primary housing, the passage provided between the printed circuit board and the primary transformer component and connecting a core space within the primary transformer component and a space external to the primary transformer component.

In a further aspect of the present invention, an external orifice may be provided on the perimeter of the primary transformer component at the passage, the external orifice located on the opposite side of the primary transformer component from where resin is poured into the primary housing. Further, a resin passage may be provided between the primary housing bottom plate and the primary transformer component and connecting a core space within the primary transformer component with a space external to the primary transformer component. An external orifice may further be provided on the perimeter of the primary transformer component at the passage, the external orifice located on the same side of the primary transformer component as where resin is poured into the primary housing. Further, the passage may run in a linear, radial path from the core space within the primary transformer component to the space external to the primary transformer component.

According to a further aspect of the present invention, the primary transformer component includes a coil channel therearound, the cylindrical end face of the primary transformer component provided on the printed circuit board and the coil channel are separated by a distance A, and the depth of the passage from the cylindrical end face of the primary transformer component is B, so that:

$$B<A.$$

According to a further aspect of the present invention, the resin passage provided between the primary housing bottom plate and the primary transformer component runs in a linear, radial path from the core space within the primary transformer component to the space external to the primary transformer component. Further, the primary transformer component may include a coil channel therearound, the cylindrical end face of the primary transformer component provided on the primary housing bottom plate and coil channel are separated by a distance C, and the depth of the resin passage from the cylindrical end face of the primary transformer component provided on the primary housing bottom plate is D, so that:

$$D<C.$$

Further, a first external orifice may be provided on the perimeter of the primary transformer component at the passage between the cylindrical end face of the primary transformer component and the printed circuit board, a second external orifice is provided on the perimeter of the primary transformer component at the resin passage between the primary transformer component and the primary housing bottom plate, and the first external orifice is located on the opposite side of the primary transformer component from the second external orifice.

A further aspect of the present invention provides a primary transformer component for a non-contact transformer, the primary transformer component attached to a bottom plate of a primary housing and including a primary coil, the primary transformer component including a cylindrical end face of the primary transformer component provided on the bottom plate of the primary housing; a printed circuit board with terminals attached thereto provided on another cylindrical end face of the primary transformer component; and a passage that receives resin as the primary transformer component is immersed in resin filling the primary housing, the passage provided between the printed circuit board and the primary transformer component and connecting a core space within the primary transformer component and a space external to the primary transformer component.

A further aspect of the present invention includes in combination, a rechargeable electric appliance; a non-contact transformer; and a primary transformer component.

BRIEF DESCRIPTION OF THE DRAWINGS

The above, and other objects, features, and advantages of the present invention will be made apparent from the following description of the preferred embodiments, given as nonlimiting examples, with reference to the accompanying drawings in which.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe various embodiments of the present invention with reference to the attached drawings.

Figure 1:
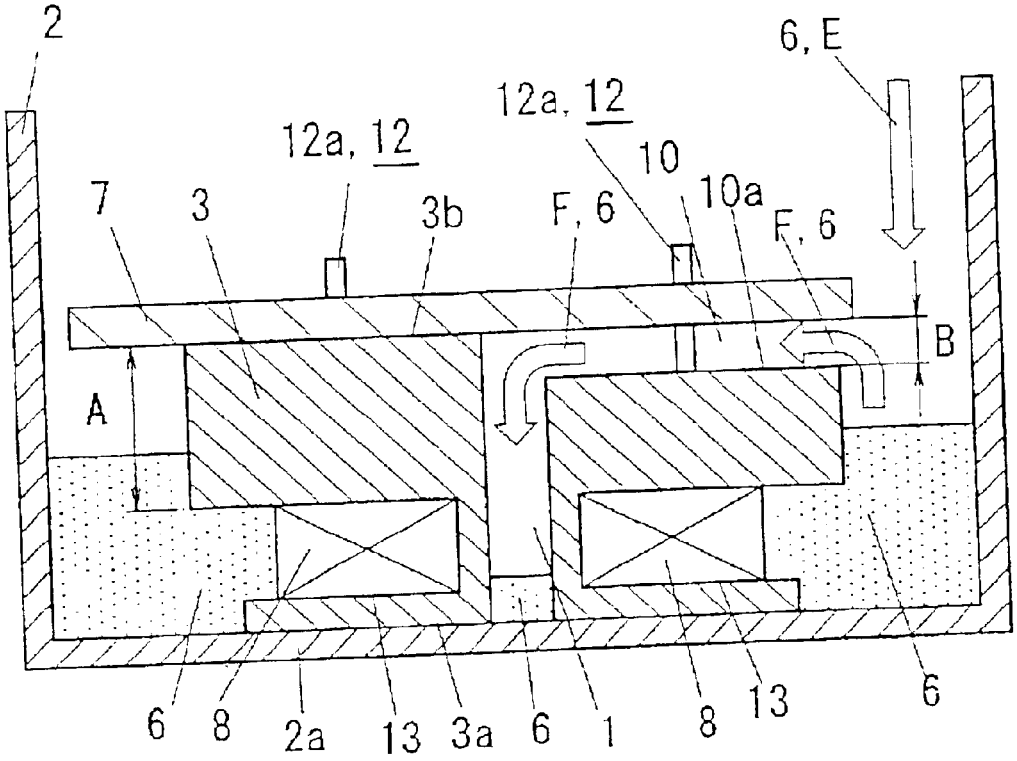
FIG. 1 is an elevational cross-sectional view of the primary transformer component in the primary housing according to a first embodiment of the present invention.
Figure 2:
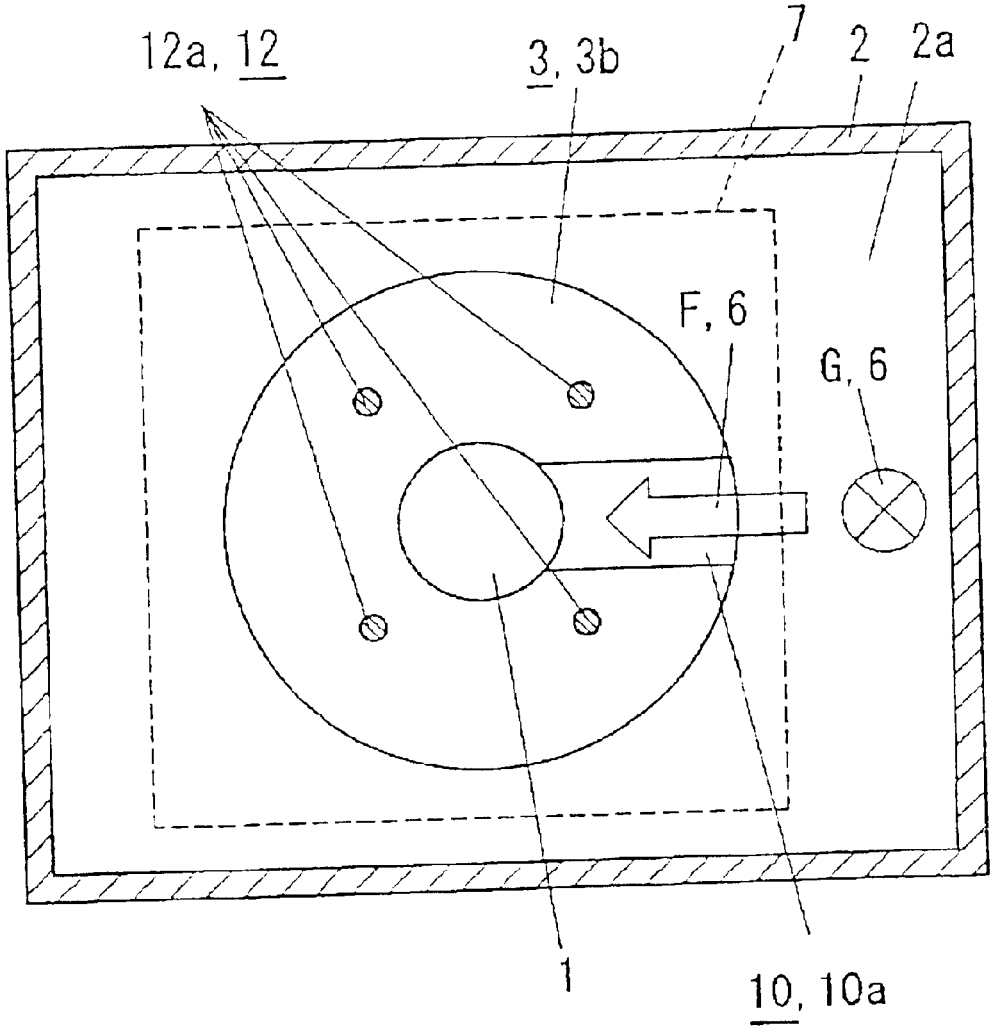
FIG. 2 is a plan view of the primary transformer component of FIG. 1.
Figure 5:
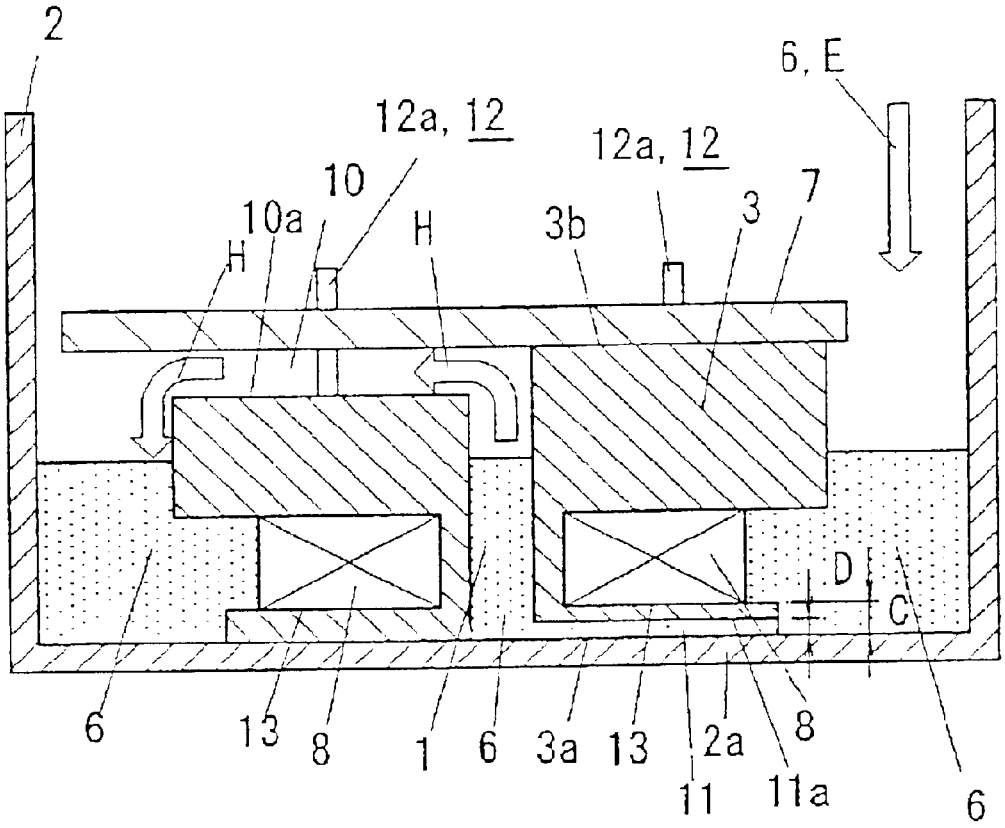
FIG. 5 is an elevational cross-sectional view of the primary transformer component in the primary housing and the resin passage between the primary transformer component and bottom plate of the primary housing according to a third embodiment of the present invention.
Figure 6:
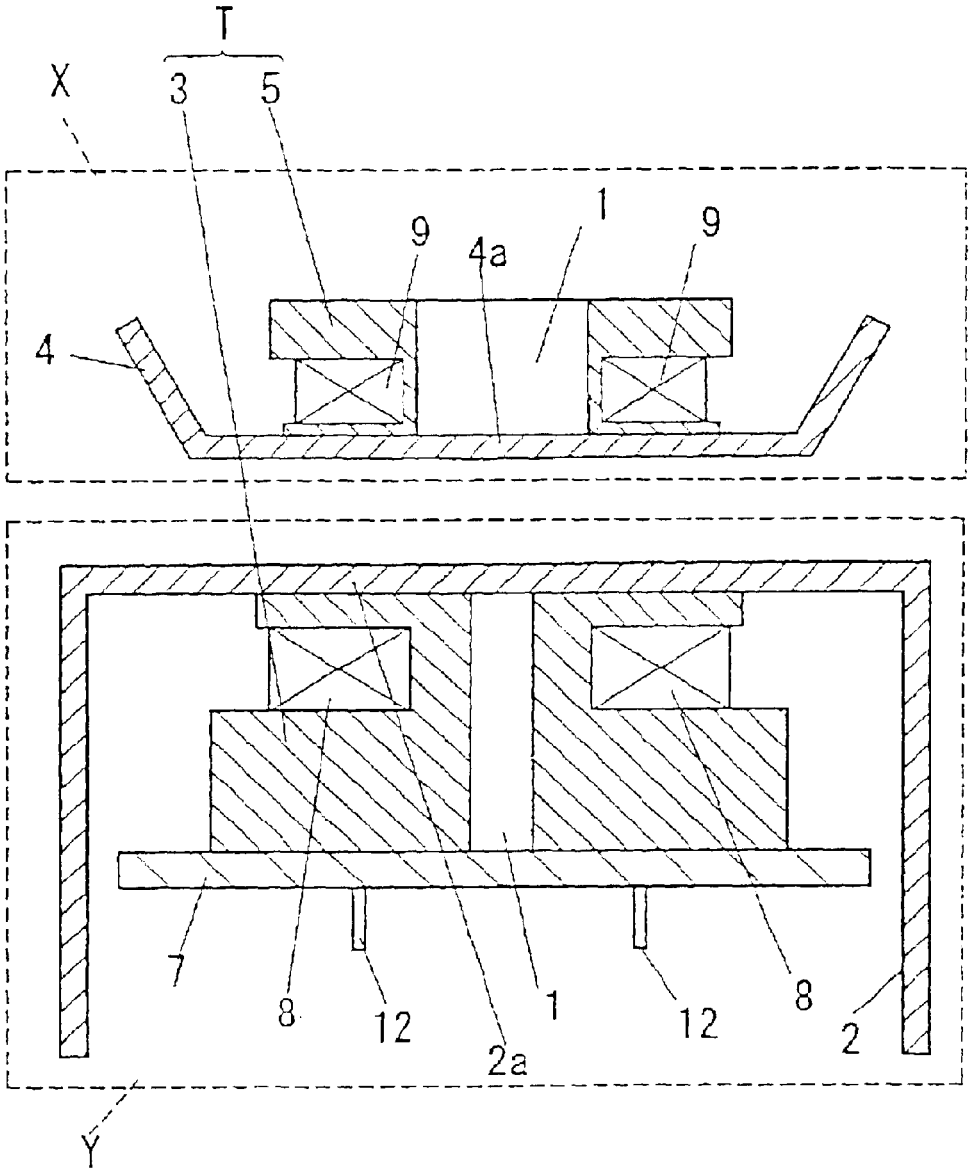
FIGURE 6 PRIOR ART
FIG. 6 is an elevational cross-sectional view of a conventional non-contact transformer.

FIGS. 1 and 2 illustrate a first embodiment of the present invention. FIGS. 1 and 2 show the positional relationship between primary transformer component 3 and primary housing 2 which form a portion of the structure of a non-contact transformer T. As shown in FIG. 5 and previously described, a prior art non-contact transformer T includes a primary transformer component 3 within primary housing 2, and secondary transformer 5 within secondary housing 4, the transformer components being oriented in mutual opposition. An electromagnetic inductance effect, which occurs between primary coil 8 of primary transformer component 3 and secondary coil 9 of secondary transformer component 5, propagates non-contact electrical current transmission between primary transformer component 3 and secondary transformer component 5. Because of the non-contact electrical current transmission effect that it provides, non-contact transformer T may be used in electrical appliances that are exposed to water such as for example, an electric toothbrush or electric shaver shown as appliance X in the figures, and in charging device Y which is used to electrically charge appliance X.

In the first embodiment, non-contact transformer T is incorporated into a water-exposed electrical appliance X and into charging device Y which is used to electrically charge appliance X. In such an application, primary housing 2 may be called the charging unit housing and primary transformer component 3 the charging unit transformer component. Also, secondary housing 4 may be called the appliance housing and secondary transformer component 5 the appliance transformer component.

Non-contact transformer T includes primary transformer component 3 and secondary transformer component 5 which are cylindrical bodies, each incorporating core space 1, and each incorporating a coil portion formed from electrical wire wound around a portion of each body. Primary transformer component 3 and secondary transformer component 5 are positioned in mutual opposition to each other, that is, the cylindrical end surfaces of each cylindrical body are in mutually facing proximity with the centers of core spaces 1 in axial alignment. The coil portions are positioned at locations in the cylindrical bodies adjacent to the opposing cylindrical end surfaces. More particularly, a coil portion is formed from electrical wire that is wound within coil channel 13 which occupies a space forced radially inward from the perimeter of the cylindrical body. The coil of primary transformer component 3 may be called primary coil 8, and the coil of secondary transformer component 5 may be called secondary coil 9.

As explained above, electricity passing through primary coil 8 generates electrical current in secondary coil 9 through an electromagnetic inductance effect. That is, electrical current is transmitted between primary coil 8 and secondary coil 9 without any physical connection being made between the coils. In this embodiment, primary coil 8 and secondary coil 9, which are within primary transformer 3 and secondary transformer 5, respectively, are located in close mutual opposition. In other words, the mutually proximal location of primary coil 8 and secondary coil 9 form a structure that prevents a reduction in the electrical transmission efficiency of non-contact transformer T. Further, while primary transformer component 3 is within primary housing 2, and secondary transformer component 5 is within secondary housing 4, the mutually opposing cylindrical end faces of primary transformer component 3 and secondary transformer component 5 are positioned in contact with bottom plates 2*a* and 4*a* of primary housing 2 and secondary housing 4, respectively, in order to locate primary coil 8 and secondary coil 9 in extremely close mutual proximity.

In the present invention, the cylindrical end face of primary transformer component 3 that is in contact with bottom plate 2*a* of primary housing 2 is the cylindrical end face 3*a*. Terminals 12 are formed from wire lead terminals 12*a* that extend upward from cylindrical end face 3*b* which is located on the side of transformer component 3 not in contact with bottom plate 2*a* of primary housing 2. Terminals 12 are electrically connected to printed circuit board 7 which is provided on cylindrical end face 3*b* on primary transformer component 3. In other words, primary transformer component 3 is sandwiched between bottom plate 2*a* of primary housing 2 and printed circuit board 7 at cylindrical end faces 3*a* and 3*b*, respectively. Core space 1 connects the space between cylindrical end faces 3*a* and 3*b*, while bottom plate 2*a* of primary housing 2 and printed circuit board 7 each substantially cover opposite ends of core space 1. This embodiment of the present invention also includes channel 10*a* which is formed within cylindrical end face 3*b* located on one end of primary transformer component 3. Channel 10*a* runs in a direct linear radial path from the upper end of core space 1 to the area external to primary transformer component 3. To further explain the structure of the cylindrical body of primary transformer component 3, taking the distance from cylindrical end face 3*b* to coil channel 13 as A, and the depth of channel 10*a* as B, the relationship between A and B is shown by the expression B<A. With printed circuit board 7 provided on cylindrical end face 3*b*, the open upper part of channel 10*a* is covered by circuit board 7 to form passage 10 that provides a linear radial path directly connecting the upper part of core space 1 to the space external to primary transformer 3.

Figure 7:
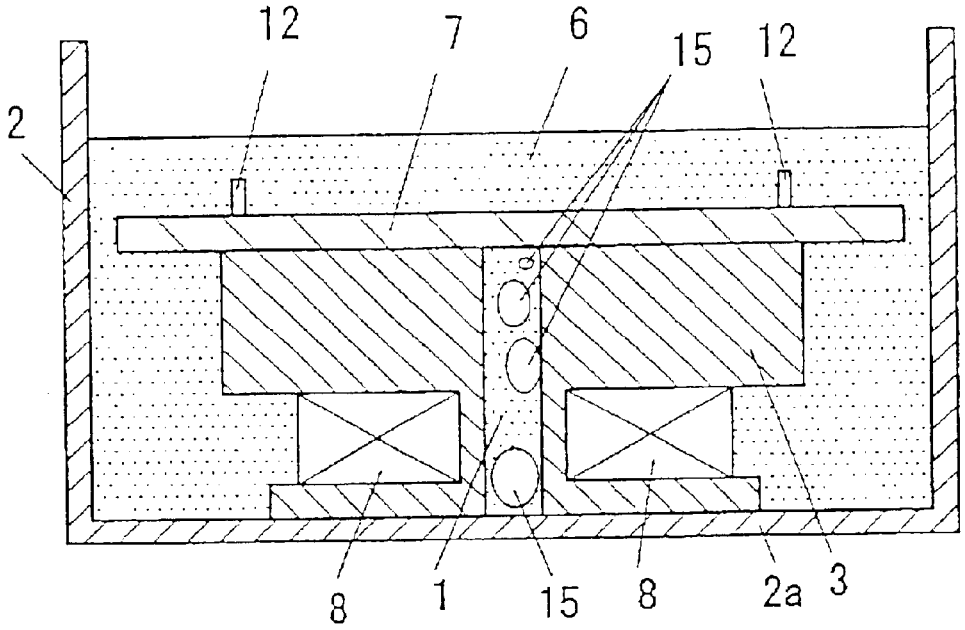
FIGURE 7 PRIOR ART
FIG. 7 is an elevational cross-sectional view of a conventional non-contact transformer depicting residual air entrapped during molding.

Primary transformer component 3 is completely embedded in resin 6 which is poured into primary housing 2 as in the conventional practice. When resin 6 fills the internal space of primary housing 2, bottom plate 2*a* of primary housing 2 acts as the bottom of a container into which resin 6 flows in the space between primary housing 2 and an area external to the cylindrical perimeter of primary transformer component 3 (arrow 'E'). As resin 6 flows into primary housing 2 and completely envelopes primary transformer component 3, core space 1 will also become filled with resin 6. That is, resin 6 gradually flows into the space between primary housing 2 and the cylindrical perimeter of primary transformer component 3, and then enters passage 10 from where it gradually flows into core space 1 (arrow 'F'). Even though core space 1 within primary transformer 3 is substantially covered by bottom plate 2*a* of primary housing 2 and printed circuit board 7, the provision of passage 10, which connects core space 1 to a space external to primary transformer component 3 between printed circuit board 7 and primary transformer component 3, prevents the entrapment of residual air 15 (see FIG. 7) within resin 6 in core space 1 of primary transformer component 3 at the time when primary transformer component 3 is being immersed in resin 6 flowing into primary housing 2. The entrapment of residual air 15 is avoided by passage 10 guiding the flow of resin 6 into core space 1 while the air within core space 1 is allowed to escape to an area external to core space 1. Even though the operation of primary transformer component 3 generates heat, distortion or other damage to primary housing 2, which can result from thermally induced expansion of residual air 15 trapped within resin 6, is thus prevented.

The following discussion will explain an additional embodiment of the present invention, but will omit descriptions of structures that do not substantially differ from the previous embodiment, and will only explain those parts of primary transformer component 3 that have been modified from the previous embodiment.

Figure 3:
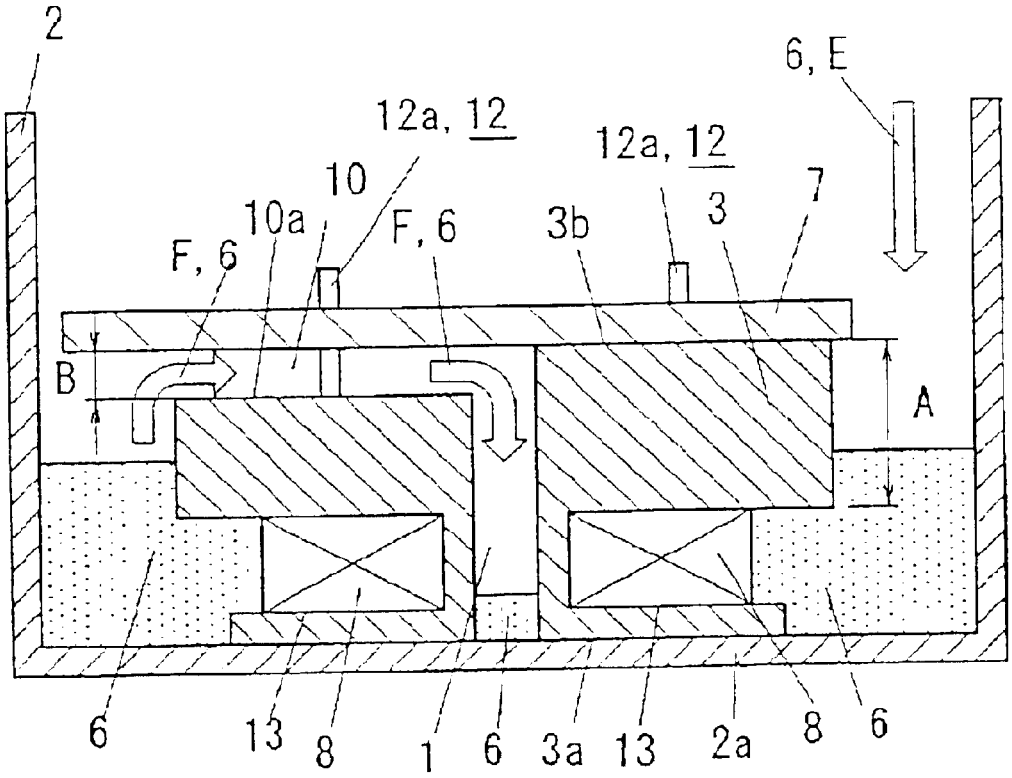
FIG. 3 is an elevational sectional view of the primary transformer component in the primary housing and the biflow passage between the primary transformer and printed circuit board according to a second embodiment of the present invention.
Figure 4:
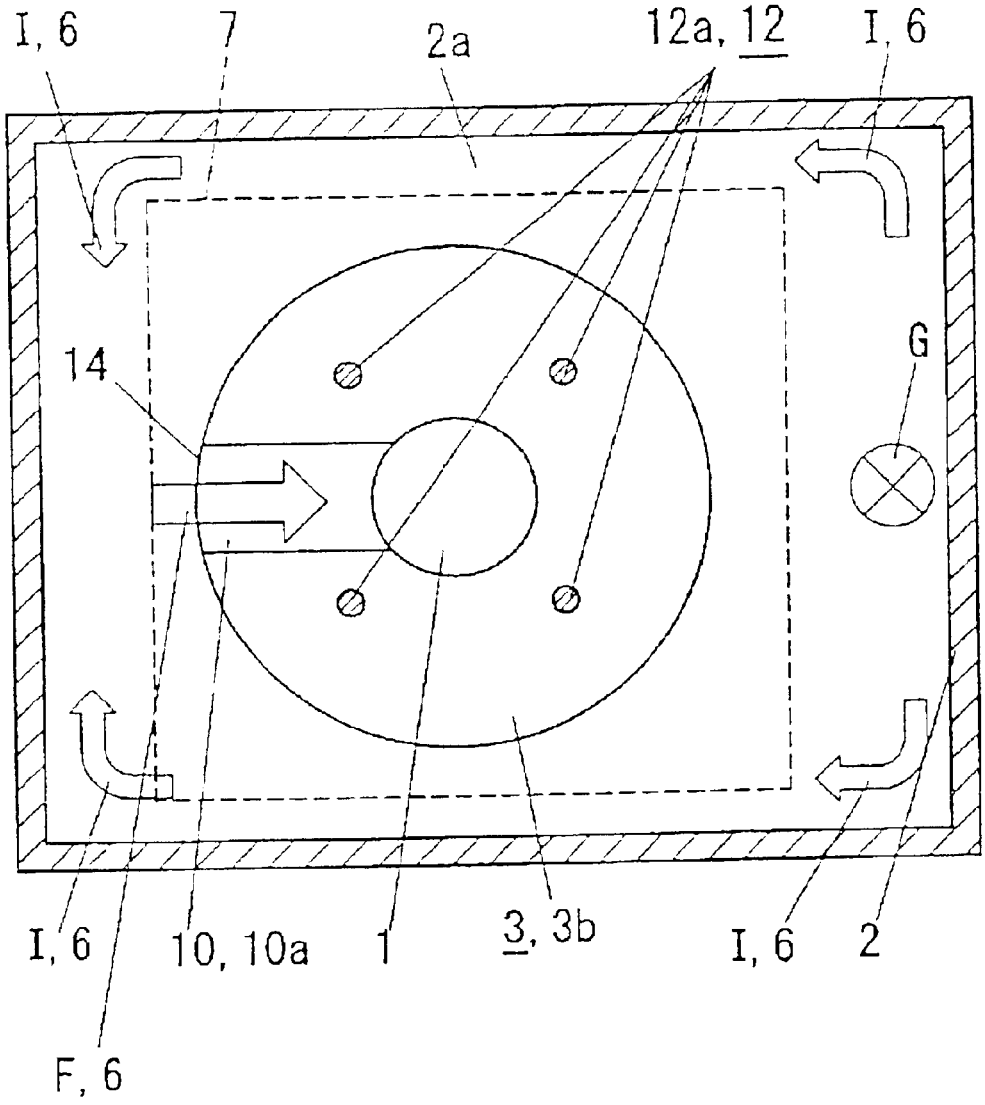
FIG. 4 is a plan view of the primary transformer component of FIG. 3.

FIGS. 3 and 4 illustrate a second embodiment of the present invention in which external orifice 14 is formed at passage 10 on the outer perimeter of primary transformer component 3 opposite to point G where resin 6 is poured into primary housing 2.

As explained in the previous embodiment, passage 10 provides a path for air within core space 1 to escape to a space external to core space 1 and also provides a path for the inflow of resin 6 from primary housing 2 into core space 1. In other words, passage 10 provides a path for both resin 6 and air in order to fulfill these functions. Resin 6 flows into primary housing 2 and gradually accumulates on bottom plate 2*a* of primary housing 2. The impact of resin 6 flowing into the area around point G can have an effect on the already accumulated resin in the form of a resin wave. It is possible for this wave of resin 6 to completely block orifice 14 at the point where passage 10 meets the external perimeter of primary transformer component 3. If a wave of resin 6 should block external orifice 14 in this manner, the airflow path provided by passage 10 to the space external to primary transformer component 3 is cut off, and the inflow of resin 6, which is devoid of residual air 15, to core space 1 is prevented.

Because this embodiment locates external orifice 14 of passage 10 at the external perimeter of primary transformer component 3 opposite to point G where resin 6 is poured into primary housing 2, resin 6 enters primary housing 2 by first flowing and accumulating around the external perimeter of primary transformer component 3 before entering passage 10 (arrow I), and is thus able to flow smoothly at a fairly steady rate to core space 1 without blocking passage 10. As this embodiment locates orifice 14 on the external perimeter of primary transformer component 3 at passage 10 opposite to point G where resin 6 flows into primary housing 2, it becomes possible to further reduce the chance of residual air 15 becoming entrapped within resin 6 in core space 1 when resin 6 is poured into primary housing 2.

FIG. 5 illustrates a third embodiment of the present invention whereby, in addition to passage 10, resin passage 11 is provided between bottom plate 2*a* of primary housing 2 and primary transformer component 3 to connect core space 1 of primary transformer component 3 to the space external to transformer component 3. In this embodiment, channel 11*a* forms a direct linear radial connection between the lower end of core space 1 at cylindrical face 3*a* of primary transformer component 3 and the space external to primary transformer component 3. Resin passage 11 is formed from channel 11*a*. In regard to the structure of channel 11*a*, with cylindrical end face 3*a* of primary transformer 3 on bottom plate 2*a* of primary housing 2, the lower opening of channel 11*a* is covered by bottom plate 2*a* of primary housing 2. Resin passage 11 thus provides a directly connecting linear radial orifice between the lower end of core space 1 and the perimeter of primary transformer component 3. Furthermore, in regard to the cylindrical body that comprises primary transformer component 3, with dimension C denoting the distance from cylindrical end face 3*a* to coil channel 13, and dimension D denoting the depth of channel 11*a*, the relationship between dimensions C and D is expressed as D<C.

In the structure described above, the provision of resin passage 11 between bottom plate 2*a* of primary housing 2 and primary transformer component 3 makes it possible for resin 6 to flow without the inclusion of residual air 15. With resin 6 flowing into primary housing 2 and gradually accumulating on bottom plate 2*a*, the provision of resin passage 11 in the vicinity of bottom plate 2*a* results in resin 6 filling core space 1 (through resin channel 11) and primary housing 2 at approximately the same rate. While the inflow of resin 6 forcibly pushes the air within core space 1 in an upward direction, the upwardly pushed air is discharged to a space external to core space 1 through passage 10 which is located between cylindrical face 3*b*, located at the other end of primary transformer component 3, and printed circuit board 7 (arrow H). In this embodiment, the air within core space 1 discharges through passage 10 to a space external to core space 1 while resin 6 fills core space 1 through resin passage 11. That is, the two passages provide separate functions that allow resin 6 to flow smoothly into core space 1 while reducing the chances of the air within core space 1 becoming entrapped within resin 6.

The non-contact transformer of the present invention provides a structure in which a cylindrical end face on one end of a primary transformer component is attached to a primary housing located in opposition to a secondary housing, and in which a printed circuit board with attached terminals is provided on the cylindrical end face of the other end of the primary transformer component. With the primary transformer component enveloped in resin that fills the primary housing, a passage is provided that connects a primary transformer component core space, located between the printed circuit board and the primary transformer component, with the space external to the primary transformer component. Even though the primary transformer component core space is predominantly covered by lid-like structures in the form of the primary housing bottom plate and the printed circuit board, when the primary transformer component becomes enveloped in resin that has been poured into the primary housing, the passage guides the resin into the core space while also guiding the air within the core space to a space external to the core space. This structure makes it possible for resin to fill the primary housing without the inclusion of air in the resin, and thus prevents thermally induced distortion of the primary housing which can result from heat, generated by the operating primary transformer component, expanding the air entrapped within the resin.

The non-contact transformer of the present invention also includes an external orifice where the passage meets the perimeter of the primary transformer component at a location opposite to the point where resin is poured into the primary housing, thereby forming a structure able to guide the resin through the passage and into the core space after the resin first flows into the primary housing and accumulates around the external perimeter of the primary transformer component. In other words, once the resin flows into the space between the perimeter of the primary transformer component and the primary housing, the resin will then flow smoothly at a fairly steady volume through the passage to the core space. This structure is thus able to prevent a sudden flow of resin that can block the passage and prevent air from escaping from the core space into a space external to the core space, and thus provides a mechanism able to maintain a stable flow of resin into the core space while further reducing the chances of air within the core space becoming entrapped within the inflowing resin.

The non-contact transformer of the present invention includes a resin passage located between the lower plate of the primary housing and the primary transformer component, that connects the core space in the primary transformer component to the space external to the primary transformer component. The resin passage is thus able to guide the flow of resin in the primary housing to the core space while the passage allows air within the core space to simultaneously escape to the space external to the core space. The separate functions provided by each of these passages allow resin to flow smoothly into and fill the core space while air is discharged from the core space to a space external to the core space, thus providing a mechanism able to further reduce the chances of air within the core space from becoming entrapped within the resin that fills the core space.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2001-293596, filed on Sep. 26, 2001, which is herein expressly incorporated by reference in its entirety.

What is claimed is:

1. A non-contact transformer including a primary cylindrical transformer component provided within a primary housing and a secondary cylindrical transformer component provided within a secondary housing located opposite the primary housing to induce non-contact electrical current transmission between the primary transformer component and the secondary transformer component through electromagnetic inductance occurring between a primary coil in the primary transformer component and a secondary coil in the secondary transformer component, said non-contact transformer comprising:

a cylindrical end face of the primary transformer component provided on a bottom plate of the primary housing located opposite the secondary housing;

a printed circuit board with terminals attached thereto provided on another cylindrical end face of the primary transformer component; and a passage that receives resin as the primary transformer component is immersed in resin filling the primary housing, said passage provided between said printed circuit board and the primary transformer component and connecting a core space within the primary transformer component and a space external to the primary transformer component.

2. The non-contact transformer according to claim 1, wherein an external orifice is provided on the perimeter of the primary transformer component at said passage, said external orifice located on the opposite side of the primary transformer component from where resin is poured into the primary housing.

3. The non-contact transformer according to claim 1, wherein a resin passage, which is provided between the primary housing bottom plate and the primary transformer component, connects a core space within the primary transformer component with a space external to the primary transformer component.

4. The non-contact transformer according to claim 1, wherein an external orifice is provided on the perimeter of the primary transformer component at said passage, said external orifice located on the same side of the primary transformer component as where resin is poured into the primary housing.

5. The non-contact transformer according to claim 1, wherein said passage runs in a linear, radial path from the core space within the primary transformer component to the space external to the primary transformer component.

6. The non-contact transformer according to claim 1, wherein the primary transformer component includes a coil channel therearound, the cylindrical end face of the primary transformer component provided on the printed circuit board and the coil channel are separated by a distance A, and the depth of said passage from the cylindrical end face of the primary transformer component is B, so that:

$$B<A.$$

7. The non-contact transformer according to claim 3, wherein said resin passage provided between the primary housing bottom plate and the primary transformer component runs in a linear, radial path from the core space within the primary transformer component to the space external to the primary transformer component.

8. The non-contact transformer according to claim 3, wherein the primary transformer component includes a coil channel therearound, the cylindrical end face of the primary transformer component provided on the primary housing bottom plate and coil channel are separated by a distance C, and the depth of said resin passage from the cylindrical end face of the primary transformer component provided on the primary housing bottom plate is D, so that:

$$D<C.$$

9. The non-contact transformer according to claim 3, wherein a first external orifice is provided on the perimeter of the primary transformer component at said passage between the cylindrical end face of the primary transformer component and the printed circuit board, a second external orifice is provided on the perimeter of the primary transformer component at said resin passage between said primary transformer component and said primary housing bottom plate, and said first external orifice is located on the opposite side of the primary transformer component from said second external orifice.

10. A primary transformer component for a non-contact transformer, said primary transformer component attached to a bottom plate of a primary housing and including a primary coil, said primary transformer component comprising:

a cylindrical end face of said primary transformer component provided on the bottom plate of the primary housing;

a printed circuit board with terminals attached thereto provided on another cylindrical end face of said primary transformer component; and a passage that receives resin as said primary transformer component is immersed in resin filling the primary housing, said passage provided between said printed circuit board and said primary transformer component and connecting a core space within said primary transformer component and a space external to said primary transformer component.

11. The primary transformer component according to claim 10, wherein an external orifice is provided on the perimeter of said primary transformer component at said passage, said external orifice located on the opposite side of said primary transformer component from where resin is poured into the primary housing.

12. The primary transformer component according to claim 10, wherein a resin passage, which is provided between the primary housing bottom plate and said primary transformer component, connects a core space within said primary transformer component with a space external to said primary transformer component.

13. The primary transformer component according to claim 10, wherein an external orifice is provided on the perimeter of said primary transformer component at said passage, said external orifice located on the same side of said primary transformer component as where resin is poured into the primary housing.

14. The primary transformer component according to claim 10, wherein said passage runs in a linear, radial path from the core space within said primary transformer component to the space external to said primary transformer component.

15. The primary transformer component according to claim 10, further comprising a coil channel around said primary transformer component, the cylindrical end face of said primary transformer component provided on the printed circuit board and the coil channel are separated by a distance A, and the depth of said passage from the cylindrical end face of said primary transformer component is B, so that:

$$B<A.$$

16. The primary transformer component according to claim 12, wherein said resin passage provided between the primary housing bottom plate and said primary transformer component runs in a linear, radial path from the core space within said primary transformer component to the space external to said primary transformer component.

17. The primary transformer component according to claim 12, further comprising a coil channel around said primary transformer component, the cylindrical end face of said primary transformer component provided on the primary housing bottom plate and coil channel are separated by a distance C, and the depth of said resin passage from the cylindrical end face of said primary transformer component provided on the primary housing bottom plate is D, so that:

$$D<C.$$

18. The primary transformer component according to claim 12, wherein a first external orifice is provided on the perimeter of said primary transformer component at said passage between the cylindrical end face of said primary transformer component and the printed circuit board, a second external orifice is provided on the perimeter of said primary transformer component at said resin passage between said primary transformer component and said primary housing bottom plate, and said first external orifice is located on the opposite side of said primary transformer component from said second external orifice.

19. In combination, a rechargeable electric appliance;

a non-contact transformer; and a primary transformer component according to claim 10.

* * * * *